US006058573A

United States Patent [19]

Silver

[11] Patent Number: 6,058,573

[45] Date of Patent: May 9, 2000

[54] FASTENER SYSTEM FOR ORNAMENTS FOR LEATHER TYPE FABRICS

[76] Inventor: Samuel Silver, 3600 Mystic Pointe Dr. #606, North Miami, Fla. 33180

[21] Appl. No.: 09/136,546

[22] Filed: Aug. 19, 1998

[51] Int. Cl.[7] ..... A44B 1/30

[52] U.S. Cl. ..... 24/105; 24/106; 24/107; 24/113 MP

[58] Field of Search ..... 24/113 R, 113 MP, 24/114.9, 114.05, 114.4, 114.1, 108, 107, 109, 105, 106, 104, 453, 696, 686, 682.1

[56] References Cited

U.S. PATENT DOCUMENTS

| | | | |
|---|---|---|---|
| 327,515 | 10/1885 | Bradley . | |
| 373,250 | 11/1887 | Simon | 24/105 |
| 808,867 | 1/1906 | Perry | 24/105 X |
| 972,309 | 10/1910 | Winston | 24/105 |
| 1,691,064 | 11/1928 | Hoppe . | |
| 1,858,686 | 5/1932 | Sharples | 24/105 |
| 1,888,169 | 11/1932 | Hollerer . | |
| 2,058,338 | 10/1936 | Meissner . | |
| 2,122,208 | 6/1938 | Lyle | 24/105 |
| 2,579,124 | 12/1951 | Patterson | 24/105 |
| 2,888,767 | 6/1959 | Pinkus . | |
| 3,623,192 | 11/1971 | Papazian | 24/105 |
| 3,715,781 | 2/1973 | Salvatori | 24/113 MP X |
| 5,308,671 | 5/1994 | Wells . | |
| 5,365,654 | 11/1994 | Moulton . | |
| 5,584,104 | 12/1996 | Stuart . | |

FOREIGN PATENT DOCUMENTS

| | | | |
|---|---|---|---|
| 388993 | 8/1908 | France | 24/105 |
| 2080 | of 1909 | United Kingdom | 24/105 |

*Primary Examiner*—James R. Brittain
*Attorney, Agent, or Firm*—Robert E. Pershes

[57] ABSTRACT

A fastener system which can be utilized with leather type fabric, such as shoes for attaching decorative pieces which consists of a flat disk shaped member which has a protruding component which interlocks with another flat disk shaped component which has a receiving component. The tolerances allow the two disk shape components to be affixed together such that they hold an ornamental piece in a certain position. The two disks sit parallel with each other or can be dimensioned to allow one to sit into the other such that on one side the two pieces create a relatively flat surface in relationship to the surface of the fabric. These configurations permit the ornament to be attached to the clothing without the feel of a lump or projection to the person wearing the article. This result is highly desirable, for example, at the instep of shoes where ornaments are often attached and the body is sensitive to any lump or projection.

6 Claims, 2 Drawing Sheets

FASTENER SYSTEM FOR ORNAMENTS FOR LEATHER TYPE FABRICS

BACKGROUND OF THE INVENTION

1. Field of the Invention

This invention related to fastener systems in particular, to fastener systems for leather type fabrics as may sometimes be utilized in connection with shoes and wearing apparel.

2. Background of the Invention

It is popular to utilize and attach ornaments in connection with leather type fabrics used in clothing and shoes as a means of decoration and style to the apparel. While in cloth fabrics it is easy to affix such decorations by stitching, for leather type fabrics a fastener system that provides a mechanical type connection tends to work best and provide the greatest reliability, since stitching is often difficult in such fabric and the location may make stitching impractical. The problem with virtually all the methods of mechanical attachment is the creation of lumps or projections that prove to be annoying to the wearer of the apparel. Ornaments are commonly placed in shoulder areas on jackets which proves to be uncomfortable when worn if a lump or projection will create pressure points or discontinuity on the surface in contact with the shoulder. It is very popular in the shoe industry to use such ornaments to stylize the shoes. In mens shoes especially, having ornaments located at the front top portion of the shoe in the area above the foot instep is common. This area of the foot, called the instep, located on the top surface of the foot between the toes and ankle, is very sensitive to and readily indicates any feeling of a pressure point or discontinuity of the surface it is in contact with. In fact, the sensitivity of the foot, in the instep area, is so great that ornaments used for shoes typically utilize a strap running from one side of the shoe sole to the opposite side of the sole, as the vehicle for holding the ornament in place. This strapping method is utilized so that the attachment of the ornament will not exert any pressure on the foot instep and thereby cause discomfort. Any device which causes pressure points or surface discontinuity such as that resulting when a metal rivet, pin, or staple is utilized would not be commercially useable. The strapping method in shoes which has been utilized to overcome this problem, has the ornament fastened to the 25 leather type fabric strap which is then attached by stitching the strap at the sides of the shoe. This increases costs of production, restricts the design of the shoe, as well as the ability to change ornaments. In ornaments placed in the shoulder area of apparel, ornaments are typically added using epaulets which operates in the same manner as the strap over the front of the shoe.

In the reference patents cited, we find rivet type structures being used in Hollerer '169, Meissner patent '338 and Moulton patent '654 and pin type devices in Bradley patent '515, Stuart patent '104 and Hoppe patent '064. All of these type fastener systems create a nonuniform surface in the fabric which will create discomfort. The Pinkus patent '767 and Wells patent '671 show 10 clip and snap type mechanisms which also create discontinuities causing discomfort and further, do not provide a strong connection to keep the 15 ornament from being easily dislodged or lost.

SUMMARY OF THE INVENTION

The fastener system of the present invention satisfies the need to have a interlocking fastener for permanently connecting an article to be decorated with the ornament without creating an uncomfortable concentrated pressure point or discontinuity which will discomfort the person wearing the apparel.

It is an another aspect of this invention that the two components which lock together provide for the thickness of the material being captured so that upon locking together they create a relatively smooth surface on one side. The components are constructed of a flexible material, such as soft flexible plastic with a core engagement area of greater strength. The locking is accomplished by threads, when it is desired to have the ornament removable or alternatively by locking ribs, or adhesive, when the ornament is not removable.

BRIEF DESCRIPTION OF THE DRAWINGS

Preferred embodiments of the present invention will now be described by way of example with reference to the accompanying drawings.

DETAILED DESCRIPTION OF THE PREFERRED EMBODIMENTS

Figure 1:
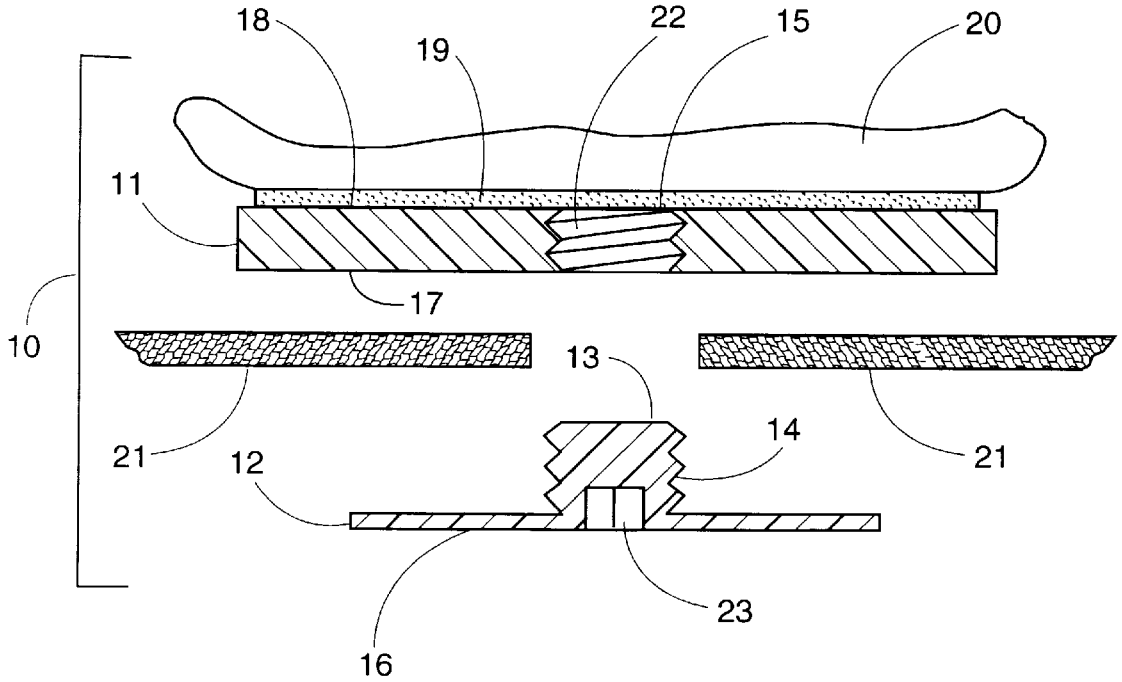
FIG. 1 is a cross-sectional view of the fastener with material inserted.

In FIG. 1 there is a depiction in cross section of the fastener 10 which would typically be molded from a plastic material the receiving disk 11 has two components a flat plate portion 17, and an aperture 15 containing screw threads 22. One surface of the receiving disk 18 is affixed to the ornament 20, by use of a cement 19, it can also be attached using fiber threads that sewn through the receiving disk 17 into the ornament. "Wire connection affixed to the receiving piece at one end, and the other end affixed to the ornament 20." The ornament with the receiving disk 11 attached is then placed over a hole on one side of the leather type fabric 21 while the retaining disk 12 is placed on the other side of the leather type fabric 21.

The retaining disk 12 has a flange section 16 typically a circular shape with a center core 13 having a cylindrical protrusion. The protrusion on its outer surface has screw threads 14 which will fit into the screw threads of the aperture in the receiving disk 22. The cylindrical protrusion has a cavity 23 which is hexagonal in shape allowing the use of a hexagonal key to rotate the retaining disk and allowing the interlocking screw threads 22 and 14 to tighten together holding the ornament onto the leather type fabric 21.

Figure 2:
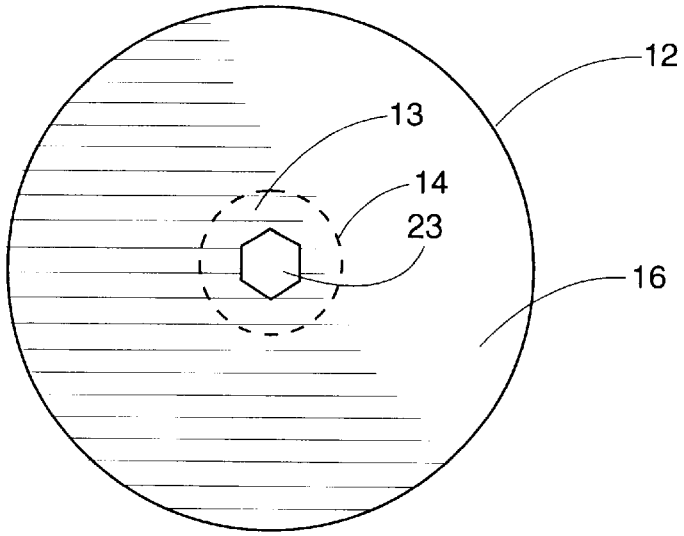
FIG. 2 is a schematic elevation of the retainer disk.

In FIG. 2 we see the retaining disk in elevation. The hexagonal cavity 23 can be replaced with any type of cavity which permits a means of rotating the retaining disk when screw threads are utilized to lock the retaining disk and the receiving disk, such as Philip, Star, flat, or similar type insertable driving tool.

The receiving disk 11 can be affixed to the ornament in any number of ways, such as, flexible or rigid cement 19, fiber thread or pins located at various locations along the flat plate 17.

Figure 3:
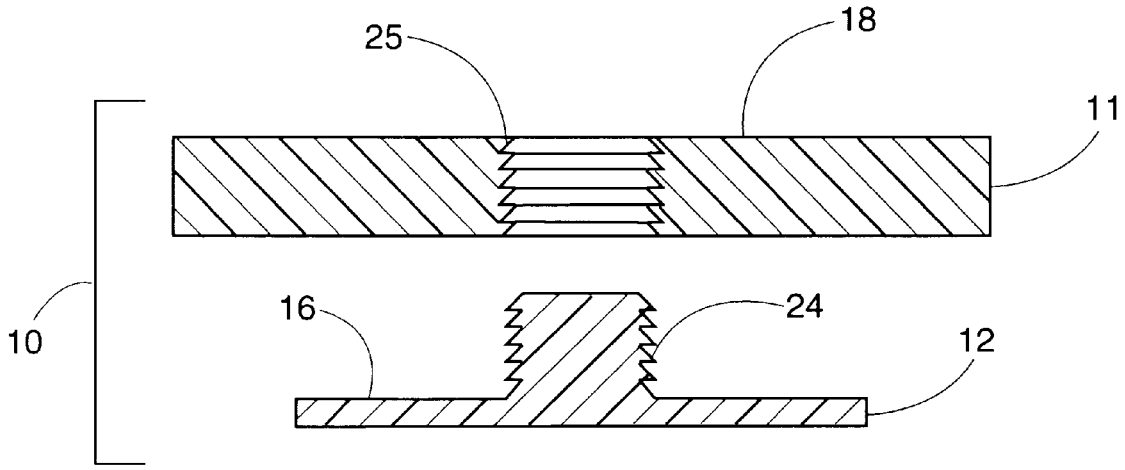
FIG. 3 is a cross-sectional view of the core area showing a ribbed locking mechanism.

The cavity 23 does not have to be present when the interlocking is done utilizing a non-releasing mechanism such as ribs, shown in FIG. 3. FIG. 3 shows a locking rib system which interlocking between downward pointed ribs 24 and upward pointed ribs 25. The receiving disk and retaining disk are then pressed together to cause the locking.

Figure 4:
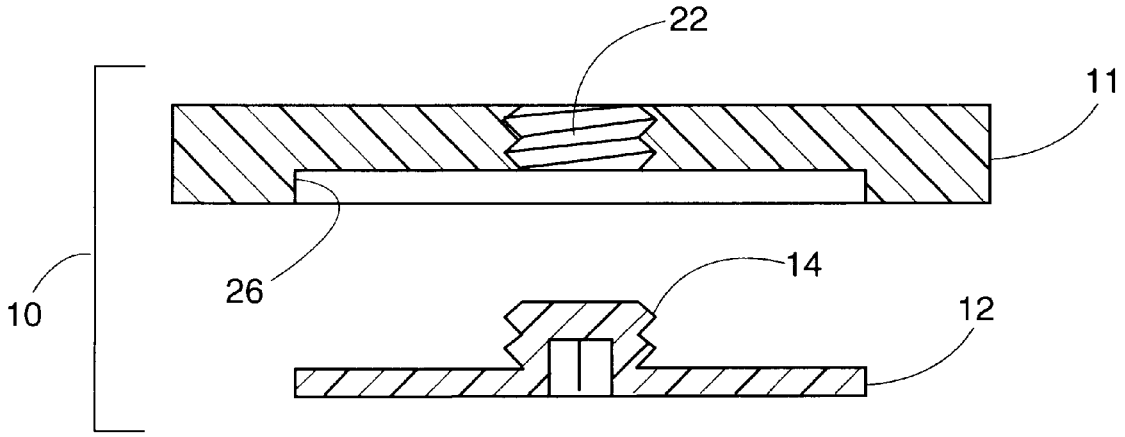
FIG. 4 is an alternate configuration of the fastener without material inserted.

In FIG. 4 we see an alternate configuration wherein the receiving disk 11 has a depression 26 which is equal or greater in diameter to the diameter of the retaining disk 12. This allows the fabric to be pressed into the depression creating a flatter surface on the side of the fabric which is in contact with the wearer of the apparel.

It will be apparent to one skilled in the art that some modifications and alterations are obvious without departing from the spirit of the invention. Such changes are not to be considered beyond the scope of the present invention. For example, in the nonremovable configuration any type of interlock may be utilized such as cement, or adhesive, "as shown in FIG. 5 wherein the cement 27 is placed in the receiving disk 11." with or without ribs or threads. The flanges may be in other shapes then circular, and the material for these flanges and hereby need not be made of plastic, but can be made of this fibre materials. Therefore, the foregoing description is considered to be exemplary and the scope of the invention is that defined in the following claims:

What I claim is:

1. A fastener system for attaching an ornament to a fabric, the fastener system comprising:

a receiving disk consisting of a flat plate which is affixed to an ornament, containing a depression less in diameter than the diameter of the receiving disk, with an aperture located within the depression;

a retaining disk consisting of a thin plate in diameter less than the diameter of the depression contained in the receiving plate and a protrusion thereon; and a means for locking the protrusion within the apertures of the receiving disk.

2. The fastener system in claim 1 wherein the retaining disk is thin and flexible.

3. The fastener system in claim 1 wherein the means for locking the protrusion on the retaining disk to the aperture of the receiving disk is by screw threads.

4. The fastener system in claim 3 wherein the cylindrical protrusion has a cavity in the shape of a hexagon.

5. The fastener system in claim 3 wherein the cylindrical protrusion has a cavity in the shape of one or more slots.

6. The fastener system in claim 1 wherein the means for locking is ribs on the protrusion on the retaining disk interlock with a rib in the aperture of the receiving disk.

* * * * *